US006976409B2

(12) United States Patent
Shu

(10) Patent No.: US 6,976,409 B2
(45) Date of Patent: Dec. 20, 2005

(54) SELECTIVE ONE-WAY BIT-DRIVING APPARATUS

(76) Inventor: Zu-Shung Shu, No. 11, Alley 11, Lane 25, Kuo Chung 1st Road, Ta Li City, Taichung Hsien (TW)

( * ) Notice: Subject to any disclaimer, the term of this patent is extended or adjusted under 35 U.S.C. 154(b) by 0 days.

(21) Appl. No.: 10/822,452

(22) Filed: Apr. 12, 2004

(65) Prior Publication Data

US 2005/0204869 A1 Sep. 22, 2005

(30) Foreign Application Priority Data

Mar. 17, 2004 (TW) ..... 93107037 A

(51) Int. Cl.[7] ..... B25B 13/46
(52) U.S. Cl. ..... 81/62; 81/58.4
(58) Field of Search ..... 81/60–62, 58, 81/58.4, 63.1; 192/43.1

(56) References Cited

U.S. PATENT DOCUMENTS

| | | | | |
|---|---|---|---|---|
| 2,744,432 | A * | 5/1956 | Rueb | 81/62 |
| 6,250,183 | B1 * | 6/2001 | Chiang | 81/63.1 |
| 6,349,619 | B1 * | 2/2002 | Liao | 81/62 |
| 6,644,147 | B1 * | 11/2003 | Huang | 81/62 |

* cited by examiner

*Primary Examiner*—Debra S Meislin
(74) *Attorney, Agent, or Firm*—Alan D. Kamrath; Nikolai & Mersereau, P.A.

(57) ABSTRACT

A selective one-way bit-driving apparatus includes a shaft for connection with a handle, a bit receiver including a plurality of teeth formed on an internal face, two one-way drivers pivotally connected with the shaft and each formed with a plurality of teeth for engagement with the teeth of the bit receiver and a switch installed on the shaft for causing the engagement of the teeth of at least one of the one-way drivers with the teeth of the bit receiver.

18 Claims, 8 Drawing Sheets

SELECTIVE ONE-WAY BIT-DRIVING APPARATUS

FIELD OF INVENTION

The present invention relates to a selective one-way bit-driving apparatus.

BACKGROUND OF INVENTION

Referring to FIG. 8, a conventional selective one-way bit-driving apparatus 70 is provided between a handle 72 and a bit 74. The selective one-way bit-driving apparatus 70 includes a shaft 76 and a bit receiver 78. The shaft 76 includes a first section for connection with the handle 72 and a second section. The bit receiver 78 includes a first space for receiving the second section of the shaft 76 and a second space for receiving the bit 74. Teeth 79 are formed on the wall of the first space of the bit receiver 78. The shaft 76 drives the bit receiver 78 in selective one of two directions through two one-way drivers 80. A detent 82 is installed on the second section of the shaft 76. A switch 84 in the form of a ring is provided around the second section of the shaft 76. The switch 84 includes two recesses 86 in an internal face in order to receive the selective one-way drivers 80. Moreover, the switch 84 includes, in the internal face, three recesses 88, one of which receives the detent 82 in order to keep the switch 84 in selective one of three positions on the second section of the shaft 76. Each of the one-way drivers 80 is engaged with the teeth 79 at only one point. The form of the one-way drivers 80 is not compliant with that of the teeth 79. These factors allow the one-way drivers 80 and the teeth 79 to slide relative to and wear away each other. Hence, this engagement cannot transmit adequate torque from the shaft 76 to the bit receiver 78.

The present invention is therefore intended to obviate or at least alleviate the problems encountered in the prior art.

SUMMARY OF INVENTION

It is an objective of the present invention to provide a robust selective one-way bit-driving apparatus.

It is another objective of the present invention to provide a reliable selective one-way bit-driving apparatus.

According to the present invention, a selective one-way bit-driving apparatus includes a shaft for connection with a handle, a bit receiver including a plurality of teeth formed on an internal face, two one-way drivers pivotally connected with the shaft and each formed with a plurality of teeth for engagement with the teeth of the bit receiver and a switch installed on the shaft for causing the engagement of the teeth of at least one of the one-way drivers with the teeth of the bit receiver.

Other objectives, advantages and novel features of the present invention will become more apparent from the following detailed description referring to the attached drawings.

BRIEF DESCRIPTION OF DRAWINGS

The present invention will be described via detailed illustration of two embodiments referring to the drawings.

DETAILED DESCRIPTION OF EMBODIMENTS

Figure 1:
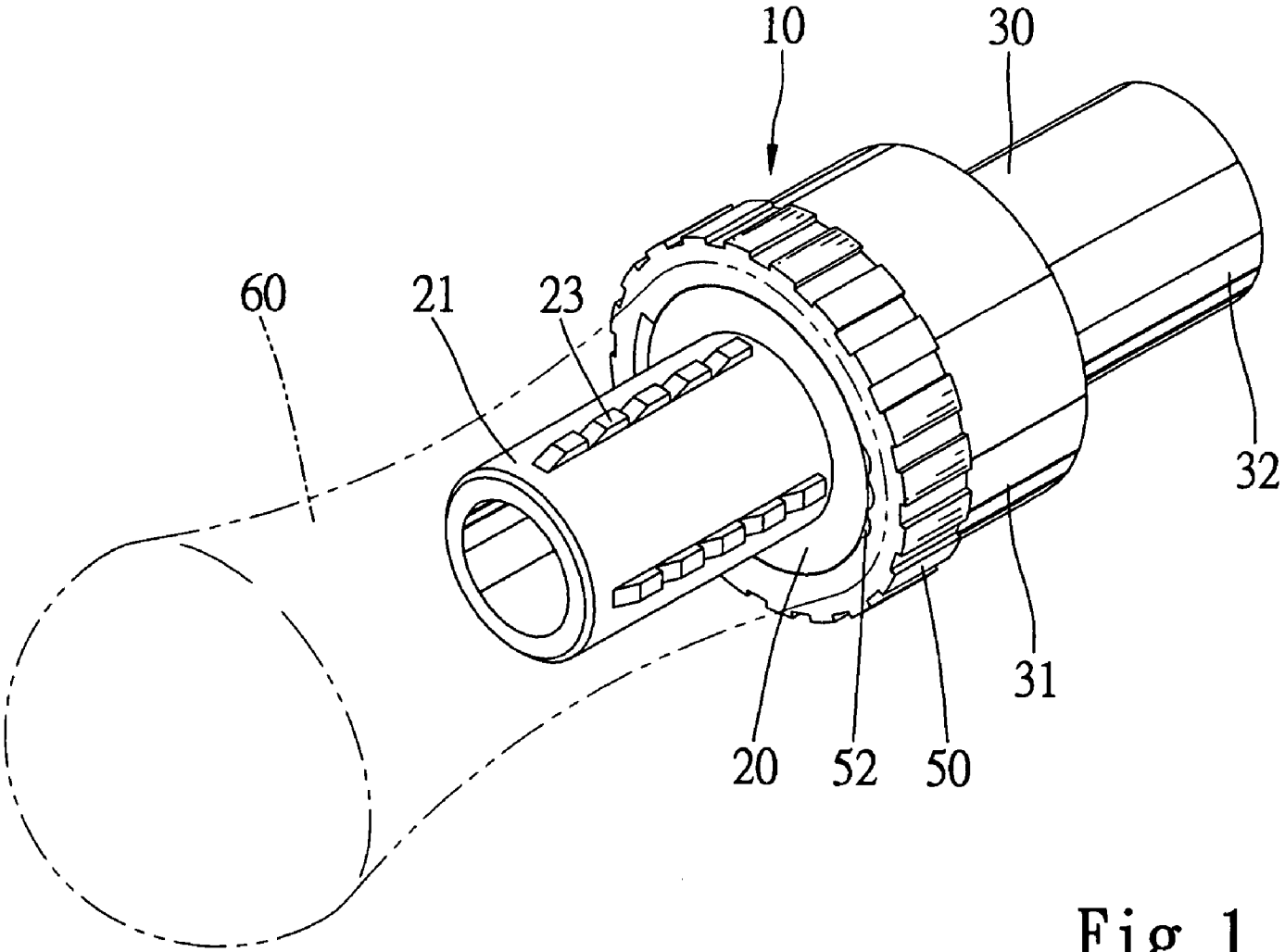
FIG. 1 is a perspective view of a selective one-way bit-driving apparatus according to a first embodiment of the present invention.

Referring to FIG. 1, according to a first embodiment of the present invention, a selective one-way bit-driving apparatus 10 is engaged with a handle 60 in order to drive a bit (not shown).

Figure 2:
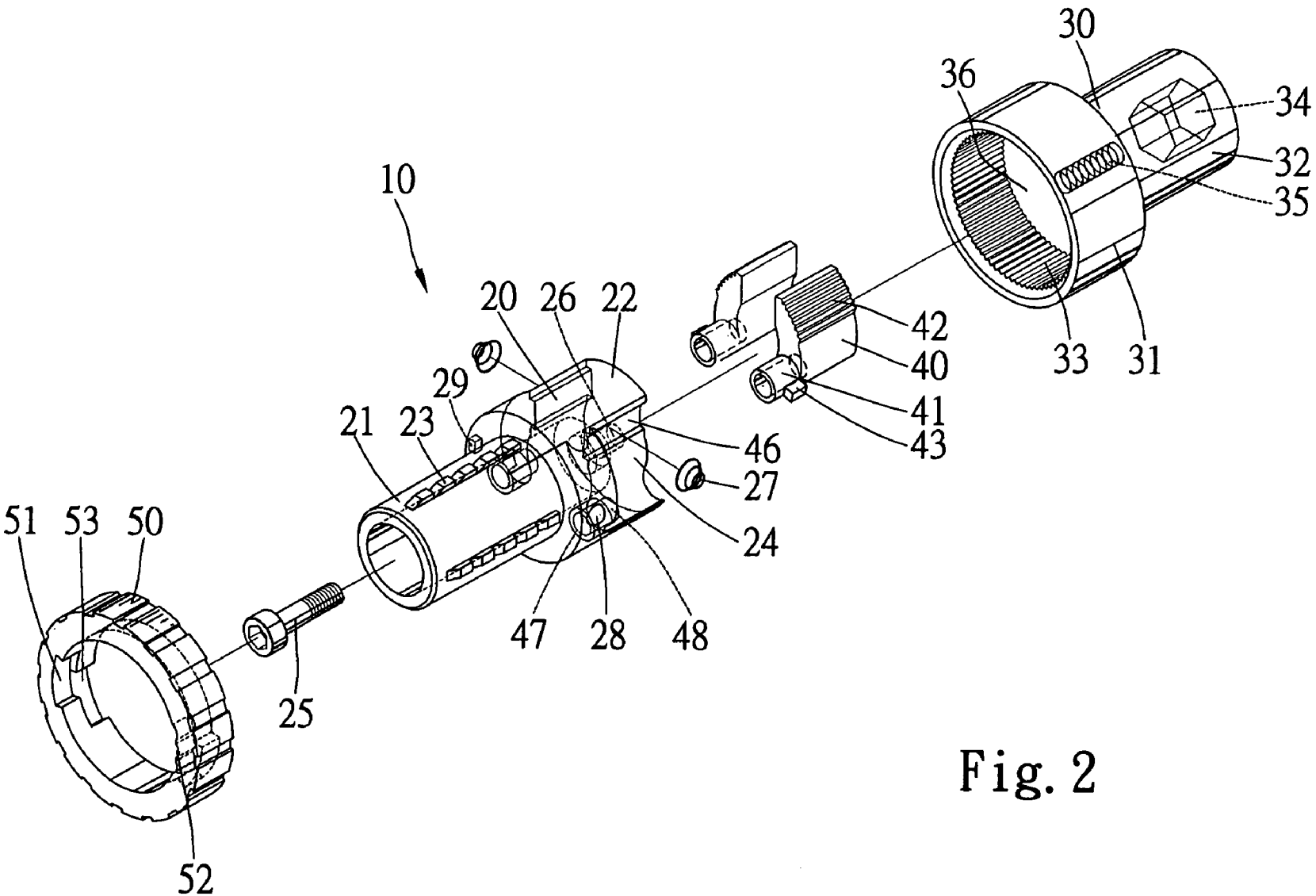
FIG. 2 is an exploded view of the selective one-way bit-driving apparatus shown in FIG. 1.

Referring to FIG. 2, the selective one-way bit-driving apparatus 10 includes a shaft 20 for connection with the handle 60, a bit receiver 30 for receiving the bit, two one-way drivers 40 each enabling the shaft 20 to drive the bit receiver 30 in only one direction and a switch 50 that can be manipulated so as to select one of the one-way drivers 40 for operation.

Figure 3:
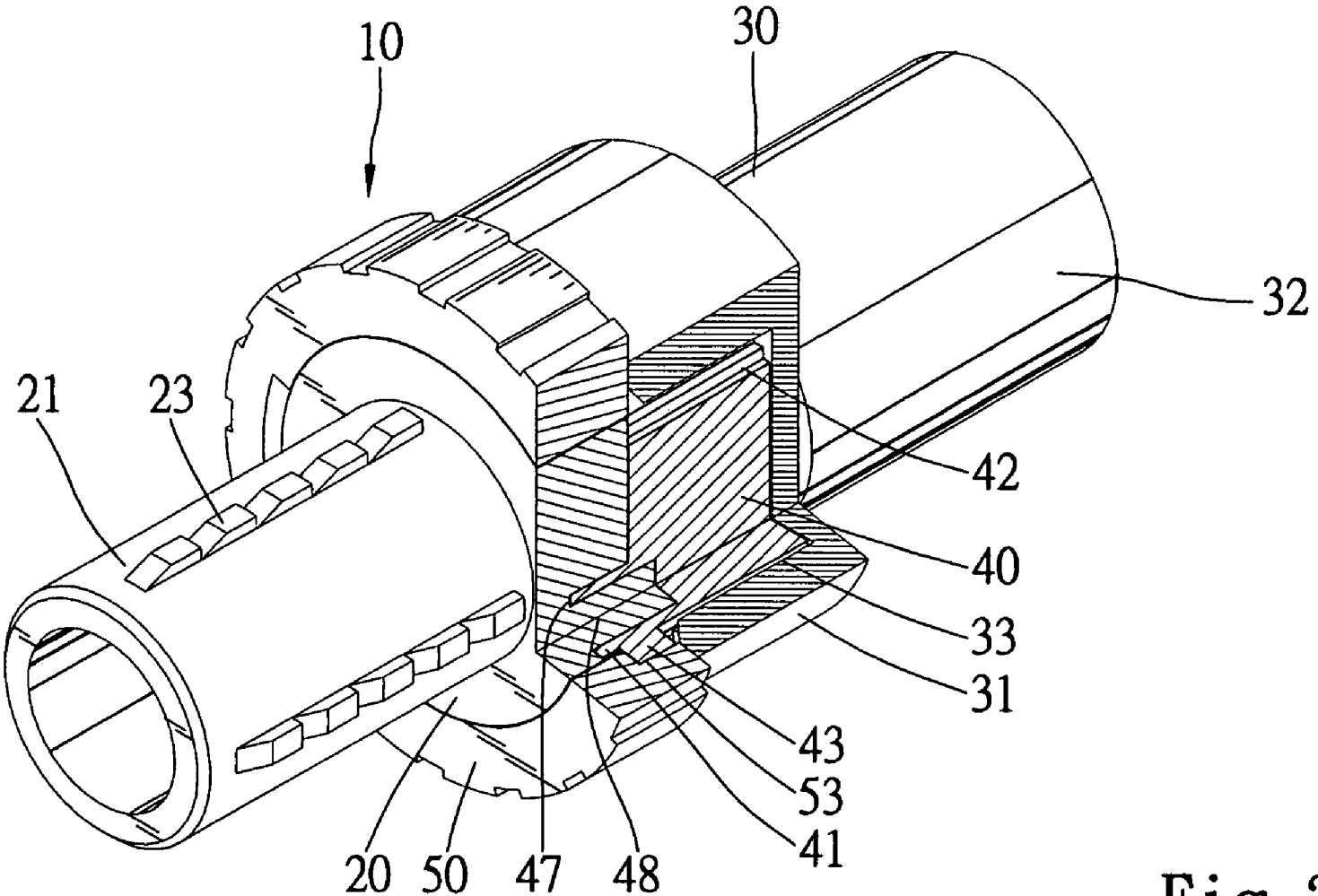
FIG. 3 is a cutaway view of the selective one-way bit-driving apparatus shown in FIG. 1.

Referring to FIGS. 2 and 3, the shaft 20 defines an axial tunnel 26. The shaft 20 includes a first section 21 and a second section 22 with an external diameter greater than that of the first section 21. On the first section 21 are formed four rows of protrusions 23 for holding on to the handle 60 when the first section 21 is inserted in the handle 60. Two recesses 24 are defined in the periphery of the second section 22. Two recesses 46 are defined in the periphery of the second section 22. A hole 47 is communicated with each of the recesses 24. A rod 48 extends from the bottom of each of the holes 47. A spring-biased detent 28 is installed on the periphery of the second section 22. A restraint 29 is formed on the periphery of the second section 22.

The bit receiver 30 includes a first section 31 and a second section 32. The first section 31 defines a space 36. A plurality of teeth 33 is formed on the wall of the space 36. The second section 32 of the bit receiver 30 defines a screw hole 35 communicated with the space 36 and a space 34 for receiving the bit.

Each of the one-way drivers 40 includes a hollow cylinder 41, a tab 43 formed on the hollow cylinder 41 and a plurality of teeth 42.

The switch 50 is in the form of a ring with an internal face in which a groove 51, three recesses 52 and two grooves 53 are defined. The groove 51 includes two ends. Each of the grooves 53 includes two ends.

The hollow cylinders 41 are inserted in the holes 47. The rods 48 are inserted in the hollow cylinders 41. Thus, the one-way drivers 40 are pivotally connected with the shaft 20. The one-way drivers 40 are put in the recesses 24. A spring 27 is compressed between each of the one-way drivers 40 and the second section 22 of the shaft 20. The springs 27 are put in the recesses 46. The one-way drivers 40 and the second section 22 of the shaft 20 are put in the space 36. The teeth 42 can be engaged with the teeth 33. A screw 25 is driven into the screw hole 35 through the axial tunnel 26 so as to hold the shaft 20, the bit receiver 30 and the one-way drivers 40 together. The switch 50 is put rotationally around the first section 21 of the shaft 20. The groove 51 receives the restraint 29 so as to limit the rotation of the switch 50 around the first section 21 of the shaft 20 within a range. Selective one of the recesses 52 receives the spring-biased detent 28. The grooves 53 receive the tabs 43 for limiting the pivoting of the one-way drivers 40 within a range.

Figure 4:
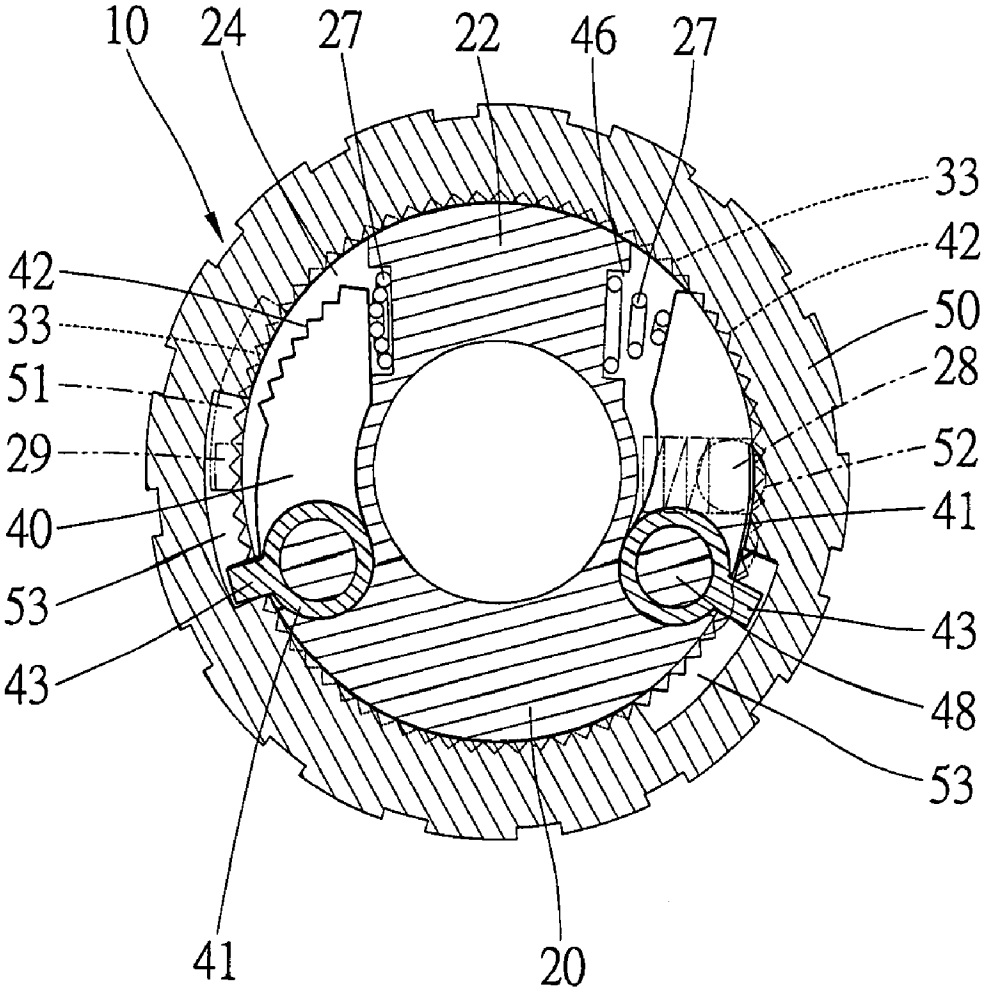
FIG. 4 is a cross-sectional view of the selective one-way bit-driving apparatus shown in FIG. 1.

FIG. 4 shows the teeth 42 of the one-way driver 40 on the right engaged with the teeth 33. Thus, the shaft 20 can drive the bit receiver 30 counterclockwise through the one-way driver 40 on the right.

Figure 5:
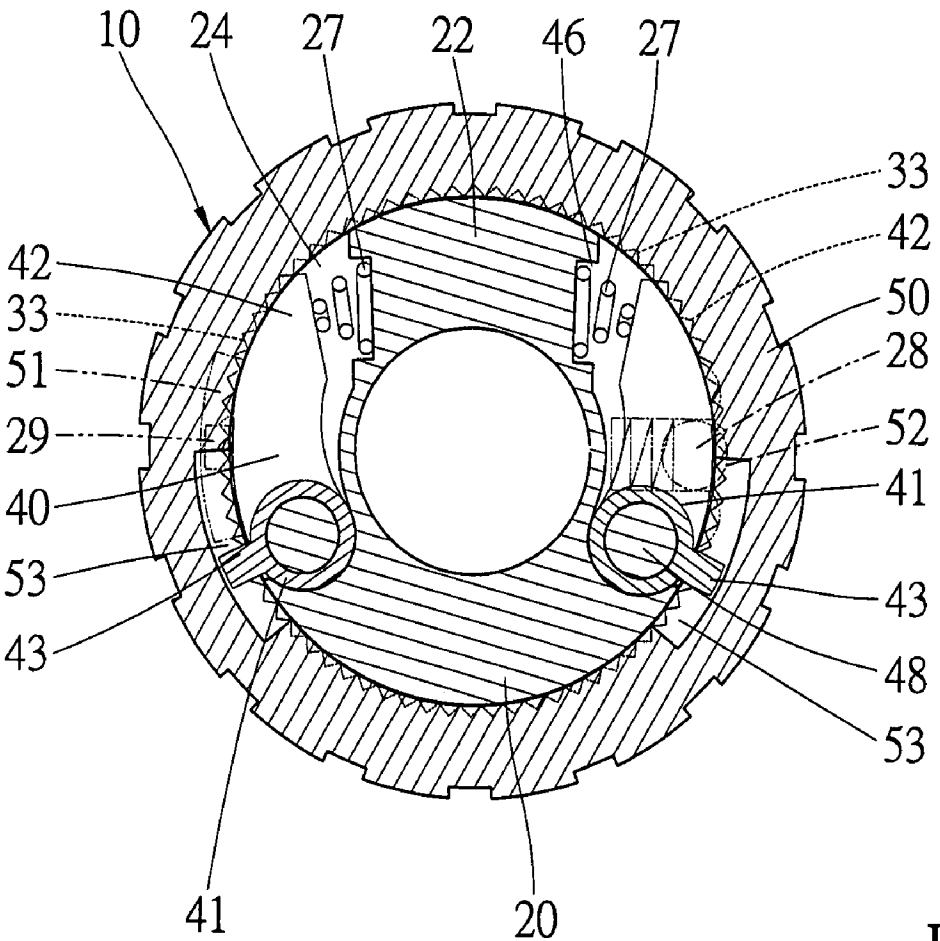
FIG. 5 is similar to FIG. 4 but shows the selective one-way bit-driving apparatus in a different position.

FIG. 5 shows the teeth 42 of the one-way drivers 40 engaged with the teeth 33. Thus, the shaft 20 can drive the bit receiver 30 in two opposite directions through the one-way drivers 40.

Figure 6:
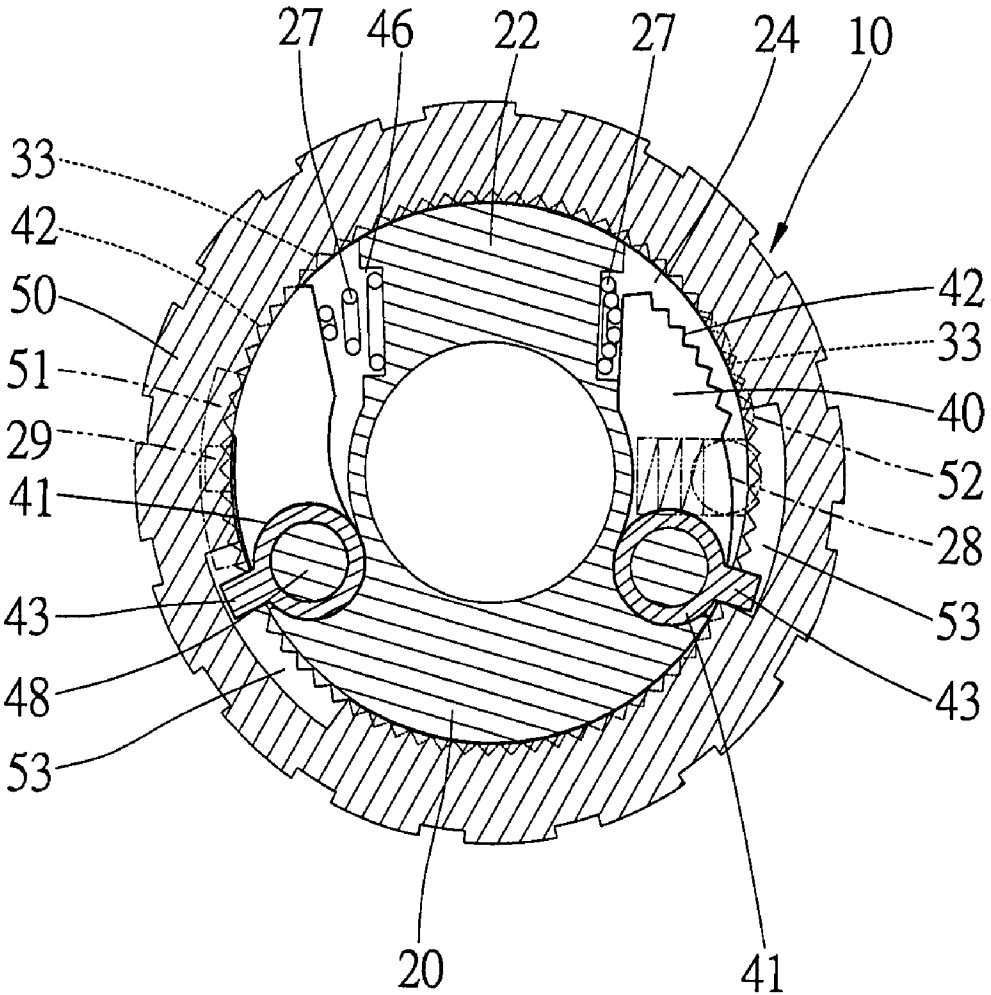
FIG. 6 is similar to FIG. 5 but shows the selective one-way bit-driving apparatus in a different position.

FIG. 6 shows the teeth 42 of the one-way driver 40 on the left engaged with the teeth 33. Thus, the shaft 20 can drive the bit receiver 30 clockwise through the one-way driver 40 on the left.

Figure 7:
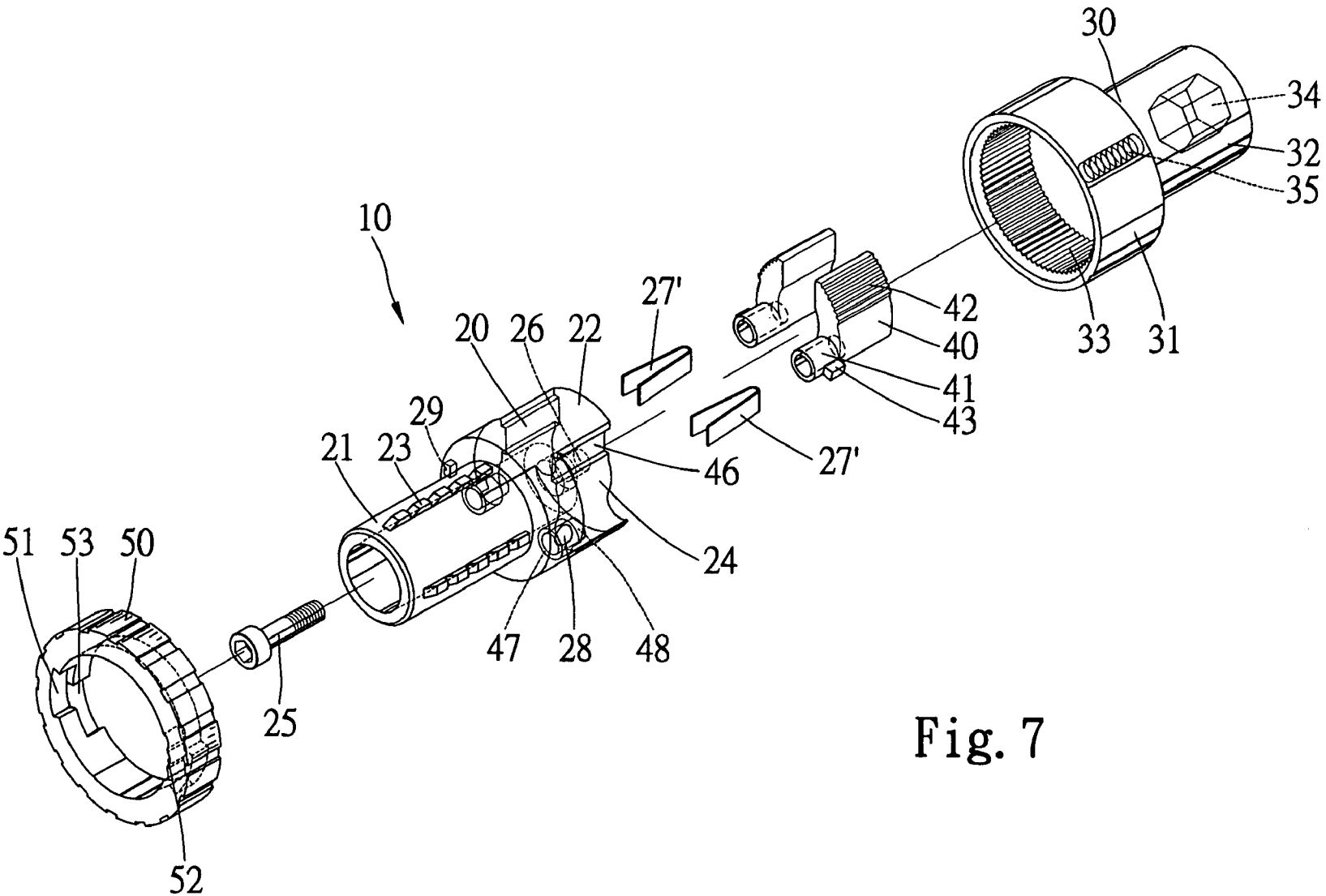
FIG. 7 is an exploded view of a selective one-way bit-driving apparatus according to a second embodiment of the present invention.
Figure 8:
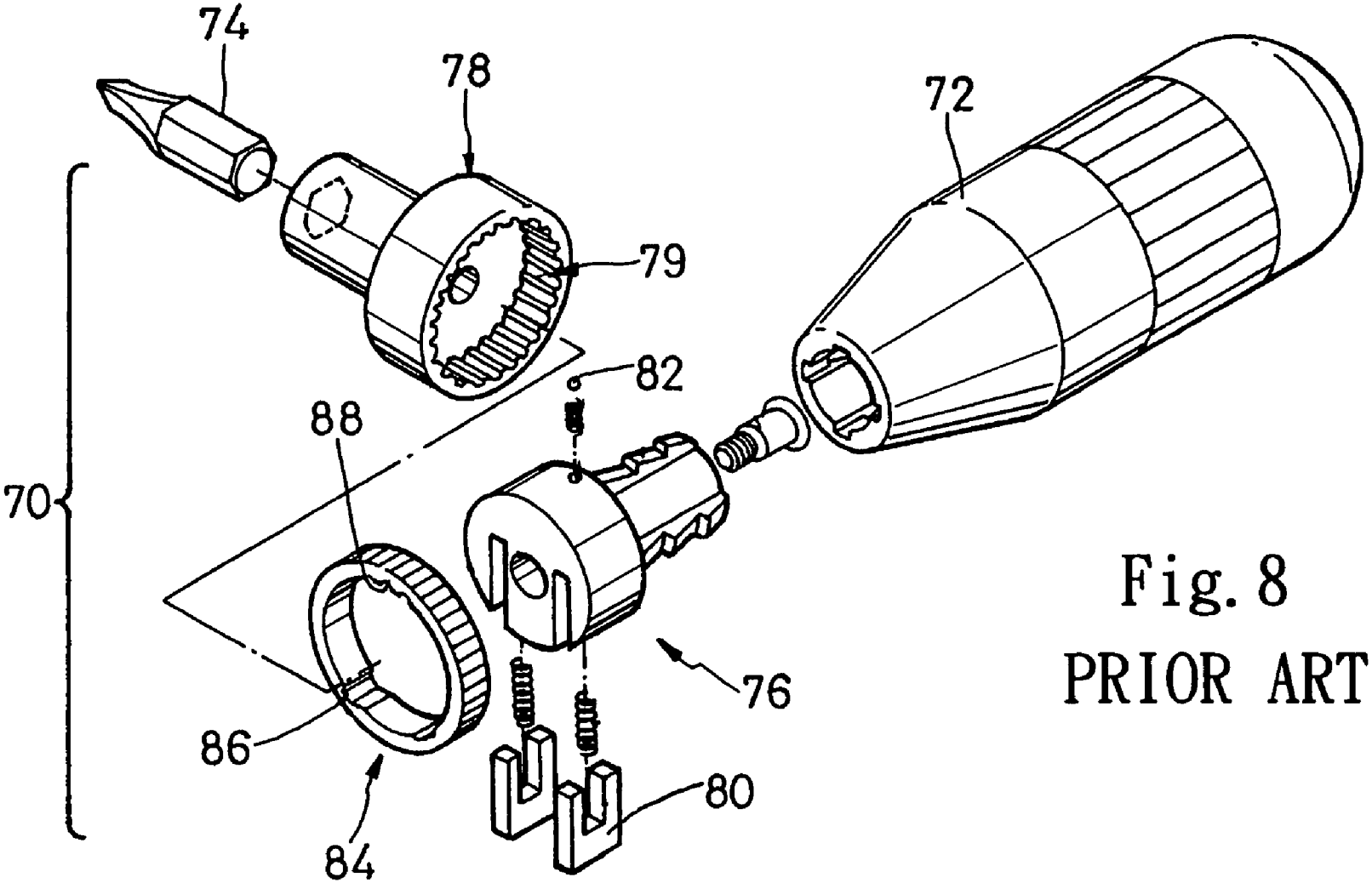
Fig. 8 PRIOR ART
FIG. 8 is an exploded view of a conventional selective one-way bit-driving apparatus.

FIG. 7 shows a selective one-way bit-driving apparatus 10 according to a second embodiment of the present invention. The second embodiment is identical to the first embodiment except for including leaf springs 27' instead of helical springs 27.

The present invention has been described via detailed illustration of the embodiments. Those skilled in the art can derive variations from the embodiments without departing from the scope of the present invention defined in the claims.

What is claimed is:

1. A selective one-way bit-driving apparatus including a shaft for connection with a handle, a bit receiver including a plurality of teeth formed on an internal face, two one-way drivers pivotally connected with the shaft and each formed with a plurality of teeth for engagement with the teeth of the bit receiver and a switch installed on the shaft for causing the engagement of the teeth of at least one of the one-way drivers with the teeth of the bit receiver, wherein the one-way drivers each include a cylinder, wherein the shaft includes two longitudinal holes each for receiving the cylinder of corresponding one of the one-way drivers.

2. The selective one-way bit-driving apparatus according to claim 1 wherein the shaft includes a plurality of protrusions for holding onto the handle.

3. The selective one-way bit-driving apparatus according to claim 1 wherein the shaft includes two recesses for receiving the one-way drivers.

4. The selective one-way bit-driving apparatus according to claim 1 wherein the shaft includes two rods each extending from the bottom of corresponding one of the longitudinal holes, wherein the cylinders of the one-way drivers are hollow for receiving corresponding the rods.

5. The selective one-way bit-driving apparatus according to claim 1 wherein the switch is in the form of a ring.

6. The selective one-way bit-driving apparatus according to claim 5 including a restraining device between the cylinder of each of the one-way drivers and the switch.

7. The selective one-way bit-driving apparatus according to claim 6 wherein the restraining device includes a tab on the cylinder of each of the one-way drivers and two recesses in an internal face of the switch for receiving the tabs.

8. The selective one-way bit-driving apparatus according to claim 7 including elastic elements each compressed between the shaft and corresponding one of the one-way drivers.

9. The selective one-way bit-driving apparatus according to claim 1 including elastic elements each compressed between the shaft and corresponding one of the one-way drivers.

10. The selective one-way bit-driving apparatus according to claim 9 wherein the shaft includes two recesses for receiving the elastic elements.

11. The selective one-way bit-driving apparatus according to claim 10 wherein the elastic elements are helical springs.

12. The selective one-way bit-driving apparatus according to claim 10 wherein the elastic elements are leaf springs.

13. The selective one-way bit-driving apparatus according to claim 1 wherein the switch is in the form of a ring.

14. The selective one-way bit-driving apparatus according to claim 13 including a positioning device between the shaft and the switch.

15. The selective one-way bit-driving apparatus according to claim 14 wherein the positioning device includes a spring-biased detent on the shaft and a plurality of recesses in an internal face of the switch for receiving the spring-biased detent.

16. The selective one-way bit-driving apparatus according to claim 13 including a restraining device between the shaft and the switch.

17. The selective one-way bit-driving apparatus according to claim 16 wherein the restraining device includes a restraint on the shaft and a groove in an internal face of the switch for receiving the restraint.

18. The selective one-way bit-driving apparatus according to claim 1 including a fastener for holding the shaft and the bit receiver together.

* * * * *